United States Patent [19]

Bottomley

[11] 3,977,129

[45] Aug. 31, 1976

[54] GRINDING MACHINE

[75] Inventor: Herbert Geoffrey Bottomley, Skipton, England

[73] Assignee: Landis Lund Limited, Keighley, England

[22] Filed: Apr. 10, 1975

[21] Appl. No.: 566,763

Related U.S. Application Data

[63] Continuation of Ser. No. 469,515, May 13, 1974, Pat. No. 3,904,390, which is a continuation-in-part of Ser. No. 447,288, March 1, 1974, abandoned.

[30] Foreign Application Priority Data

Mar. 6, 1973 United Kingdom ..... 10952/73
Oct. 10, 1973 United Kingdom ..... 47214/73

[52] U.S. Cl. ..... 51/105 R; 51/165.8; 51/238 S

[51] Int. Cl.[2] ..... B24B 5/04; B24B 42/02

[58] Field of Search ..... 51/103 C, 105 R, 165 R, 51/165.8, 165.83, 165.88, 238 S, 238 GG, 239; 82/38

[56] References Cited

UNITED STATES PATENTS

| | | | |
|---|---|---|---|
| 3,330,074 | 7/1967 | Stuckey | 51/238 S X |
| 3,391,500 | 7/1968 | Messier | 51/238 S |
| 3,427,755 | 2/1969 | Levesque et al. | 51/105 R |
| 3,561,909 | 2/1971 | Flohr | 51/239 |
| 3,691,701 | 9/1972 | Clark | 51/238 S |
| 3,736,114 | 5/1973 | Okada | 51/238 S |
| 3,743,490 | 7/1973 | Asano et al. | 51/238 S |

*Primary Examiner*—Harold D. Whitehead
*Assistant Examiner*—Nicholas P. Godici
*Attorney, Agent, or Firm*—Spencer T. Smith

[57] ABSTRACT

A cylindrical grinding machine comprising means for supporting a workpiece for rotative displacement about the axis thereof, a grinding wheel assembly including at least one grinding wheel and means for rotatively displacing the grinding wheel about the axis thereof, means for advancing the grinding wheel to a selected first position whereat further advancement of the rotating grinding wheel will effect stock removal from a rotating workpiece, a workrest jaw, means for advancing the workrest jaw along a predetermined path from a retracted position to a forward position where the workrest jaw non-deflectively contacts the rotating workpiece, means for advancing the grinding wheel from the first position and conjointly advancing the workrest jaw along the predetermined path, from the forward position at predetermined rates of advance to advanced positions substantially equidistant from the non-deflected axis of the rotating workpiece, and means for locating the workrest jaw at any selected position, along the predetermined path, intermediate the retracted and advanced positions.

6 Claims, 8 Drawing Figures

Fig_1
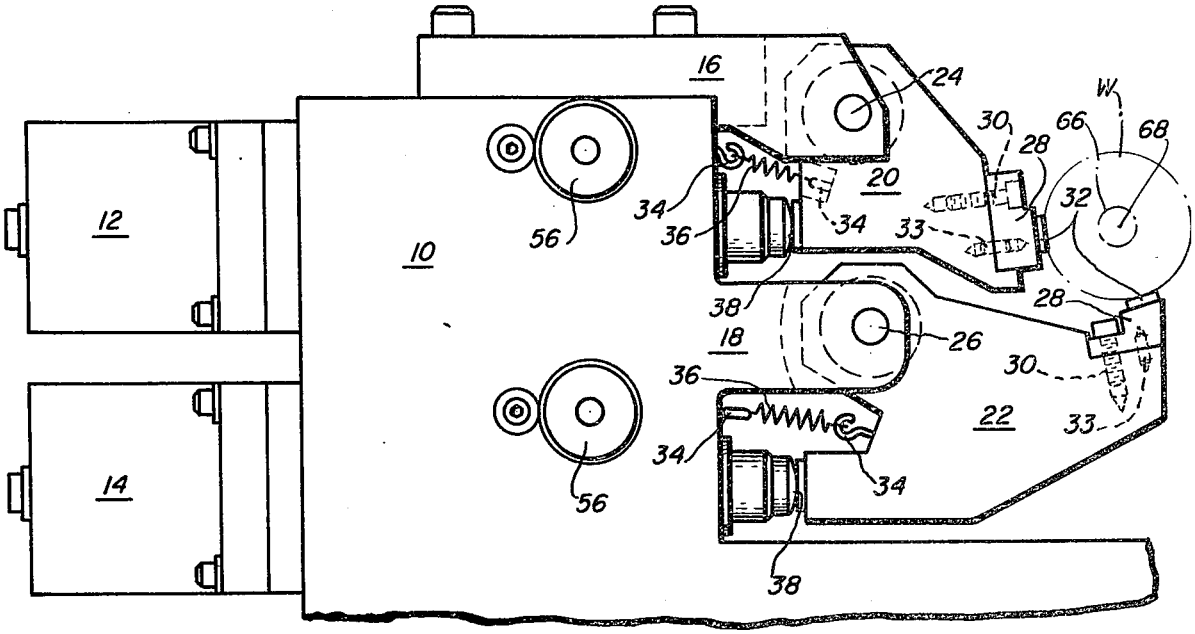
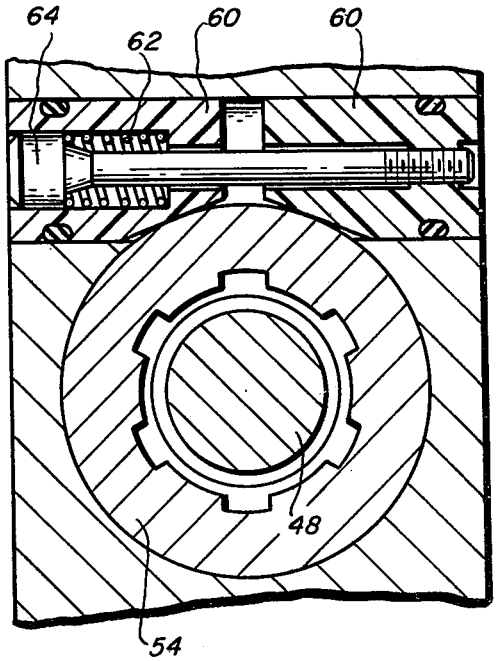
Fig_3
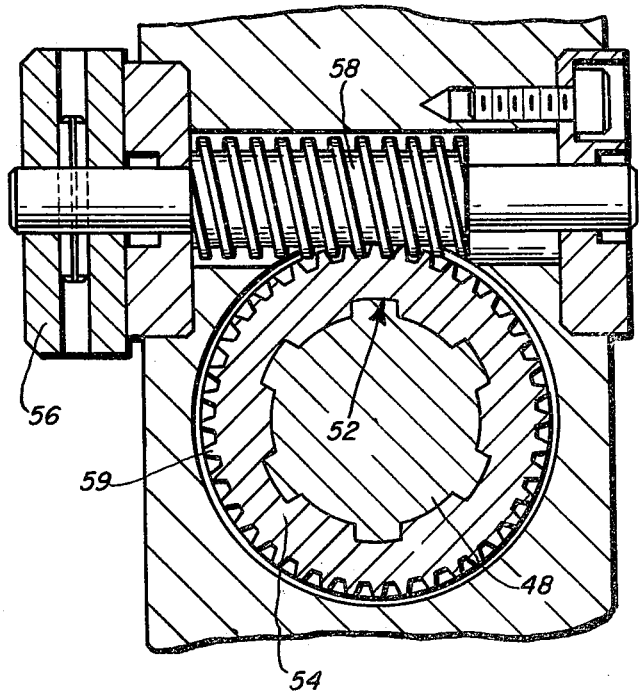
Fig_4

GRINDING MACHINE

This application is a continuation of Ser. No. 469,515, filed May 13, 1974, now U.S. Pat. No. 3,904,390, which was a Continuation-In-Part of Ser. No. 447,288, filed Mar. 1, 1974, now abandoned.

The present invention relates to grinding machines and more particularly to cylindrical grinding machines.

In cylindrical grinding machines a workpiece to be ground is supported between a pair of rotatable chuck jaws or between work centers. Thus, the axis of the workpiece is aligned with the machine axis defined by the chuck jaws or the work centers. A grinding wheel, supported in a wheelhead, is advanced towards the workpiece in a direction transverse to the machine axis to abrasively remove stock from the surface of the workpiece.

One of the difficulties which occurs with a machine of this type is that where the workpiece is insufficiently rigidly supported or where the workpiece is of low rigidity, the workpiece tends to bow or flex away from the machine axis during grinding. Any deflection of the workpiece axis away from the machine axis gives rise to errors in the finished workpiece dimensions. Such deflection also results in the uneven wearing of the grinding wheel which necessitates frequent grinding wheel dressing and this is time consuming and uneconomical.

One known solution to this problem is to provide a workrest to oppose the deflecting force of the grinding wheel whereby the workpiece axis will be maintained in the correct machining position. since the workrest supports a part of the workpiece which is itself being ground away, it is necessary to adjust the position of the workrest during the grinding operation if the workpiece is to be maintained in a correct machining position. Conventionally, the workrests are spring loaded so that they will follow the workpiece as it is being ground to size but the degree to which the workrests are spring loaded must be selectively chosen to compensate for the deflecting force generated by the workpiece. At best, this is an approximate solution.

It is an object of the present invention to provide a cylindrical grinding machine including means for continuously substantially balancing the opposing forces generated by the grinding wheel and the workrests during the grinding process.

Among the advantages of the present invention is the provision of the cylindrical grinding machine wherein the amount of deflection arising from the advancement of the grinding wheel will not substantially vary with the rate of infeed.

Other objects and advantages of the present invention will become apparent from the following portion of this specification and from the accompanying drawings which illustrate in accordance with the mandate of the patent statutes a presently preferred embodiment incorporating the principles of the invention.

Referring to the drawings:

FIG. 1 is a side elevational view of a workrest for a grinding machine made in accordance with the teachings of the present invention;

FIG. 3 is a sectional view taken on the line III—III of FIG. 2;

FIG. 4 is a sectional view taken on the line IV—IV of FIG. 2;

Figure 2:
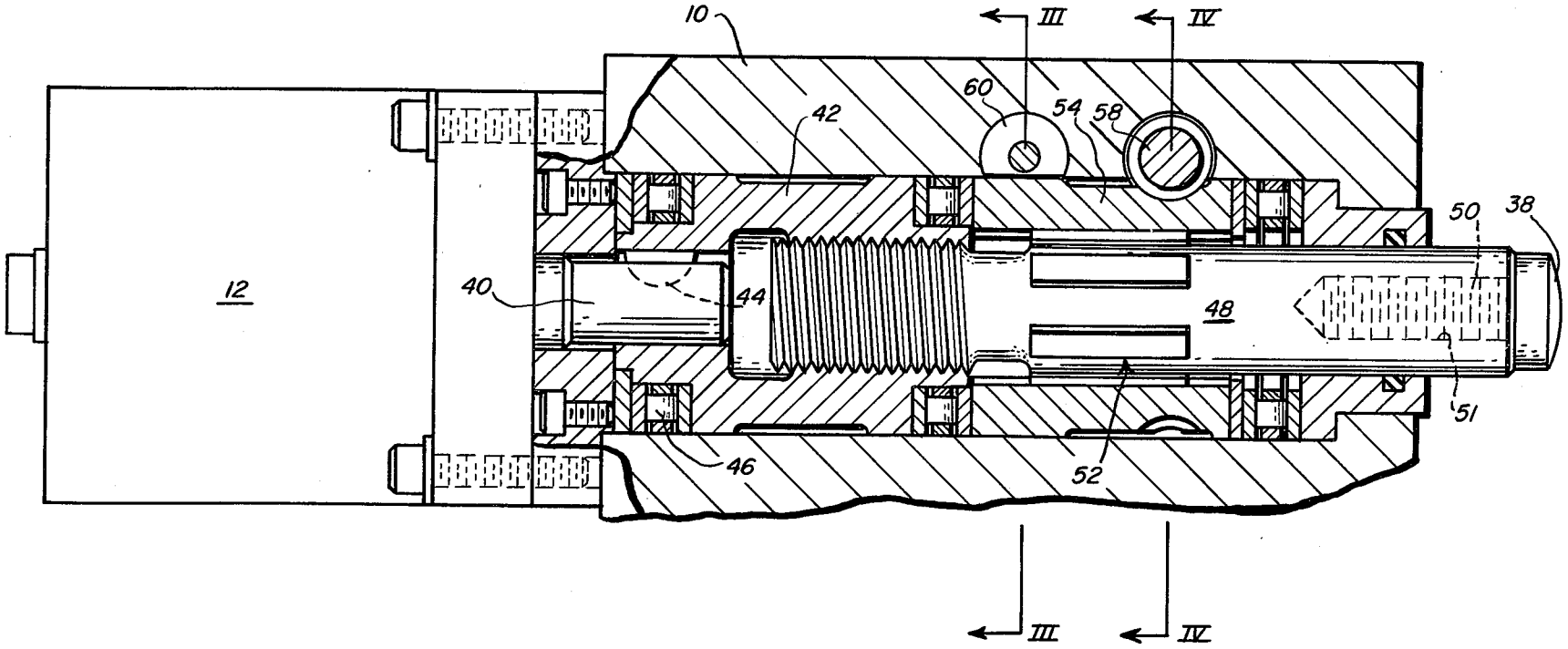
FIG. 2 is a side elevational view partly in section of a portion of the workrest illustrated in FIG. 1.

The workrest illustrated in the drawings includes a main body portion 10, which supports two stepping motors 12 and 14 at one end thereof. A pair of hanger brackets 16, 18 are mounted on the main body portion and extend beyond the other end of the main body portion and pivotally support upper and lower workrest jaws 20, 22 via suitable shafts 24, 26.

The upper 20 and lower 22 workrest jaws each include a shoe 28, which is bolted to the body of the workrest jaws by a bolt 30 or the like. A pad 32 is secured to each shoe 28 and serves to engage and support a workpiece W to be ground. Each shoe may include an indexing pin 33 to assure that the shoe will be properly located when it is bolted to the workrest jaws 20, 22.

The upper and lower workrest jaws are maintained in a fully retracted position against hardened buttons 38 protruding from the main body portion 10 by spring elements 36, which are secured to hooks 34 connected to the main body portion and the upper and lower workrest jaws.

It can be seen from FIG. 2 that the drive shaft 40 of each stepping motor extends into the main body portion 10. A nut 42 rotatably mounted in bearings 46, is keyed 44 to the drive shaft 40 for rotation therewith. A spindle 48 is threadedly received within the nut 42 whereby rotation of the nut 42 causes linear displacement of the spindle 48, and hence, button 38. The direction of displacement depends upon the direction of rotation of the nut 42. The button 38 includes a threaded shank 50, which is screwed into a bore 51 in the spindle 48 at the right-hand side of the spindle as viewed in FIG. 2.

A further part, 52 of each spindle 48 is splined as may be seen from both FIGS. 2 and 4. The splined part 52 co-operates with the splined inner surface of the associated adjuster sleeve 54, which is selectively rotatable by an adjuster knob 56 carrying a worm 58 (FIG. 4), which meshes with the worm wheel 59 cut on the external surface of the sleeve 54.

Rotation of the knob 56 rotates the sleeve 54 through the worm 58 to rotate the spindle 48 while nut 42 remains stationary. The spindle 48, and hence, the button 38 can be individually, selectively axially displaced to any desired start position.

FIG. 3 illustrates the mechanism for preventing the unintentional rotation of a sleeve 54 when the associated stepping motor is utilized. This mechanism includes a pair of pads 60, which are normally biased by a compressed spring 62 into engagement with the sleeve 54 as is illustrated in FIG. 3. The degree of compression of the spring 62, and hence, the extent of the frictional lock may be varied by tightening or loosening the bolt 64. In this position, the sleeve is frictionally locked against rotation, but can be manually rotated by turning the knob 56.

Figure 5:
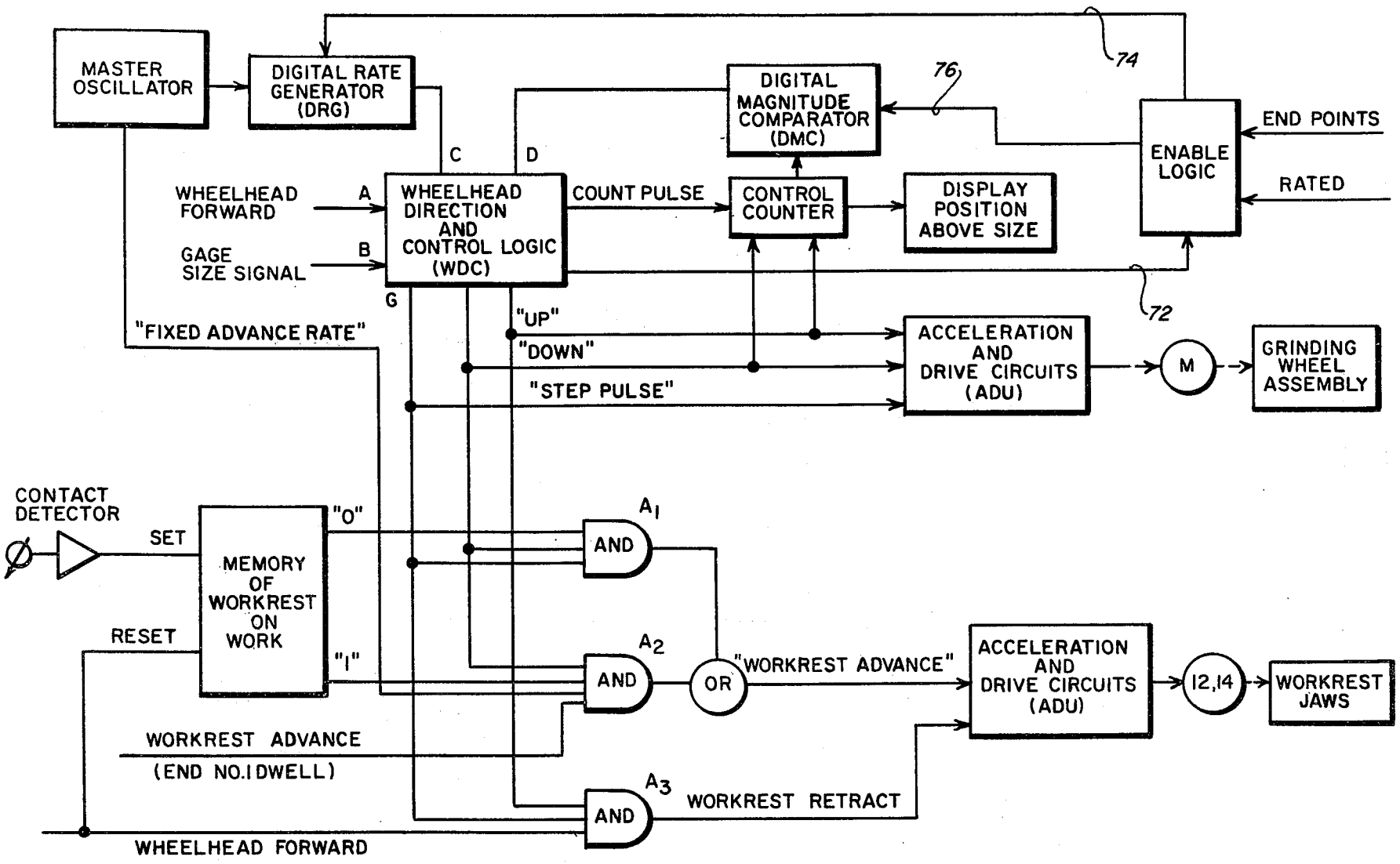
FIG. 5 is an electronic diagram schematically illustrating the control circuit for the grinding machine.

The control circuit is illustrated in FIG. 5. In operation, a workpiece W is loaded into the stocks 66 (FIG.

Figure 6:
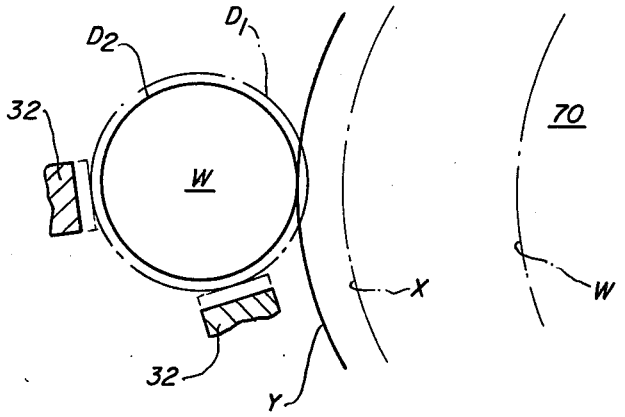
FIG. 6 is a diagrammatic representation of the rough grinding stage of a grinding cycle.
Figure 7:
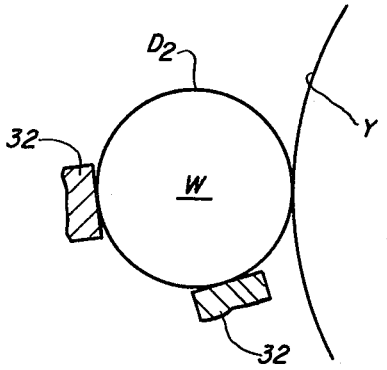
FIG. 7 is a diagrammatic representation illustrating the advancement of the workrests at the end of the rough grinding stage.
Figure 8:
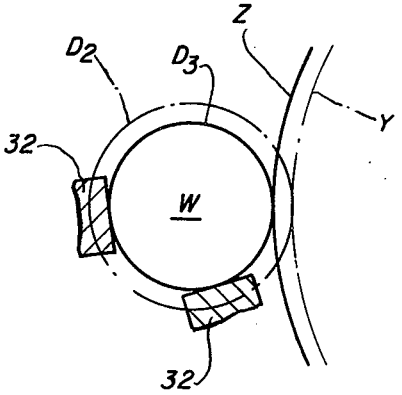
FIG. 8 is a diagrammatic representation illustrating the conjoint advancement of the workrests and grinding wheel during the finish grinding stage.

1) for rotative displacement about the axis 68 thereof. The grinding wheel or wheel head 70 (FIGS. 6, 7 and 8) is rapidly advanced from a fully retracted position X to a first forward position Y (FIG. 6) by either hydraulic or pulsed control whereupon a signal is generated at input A of a wheelhead direction and control logic (WDC), which causes an output signal to be transmitted along a line 72 to an input of an enable logic for permitting the commencement of the wheelhead feed sequence at a first grinding feed rate and also for setting a first end point for the wheelhead. The feed rates and end points are programmed into the enable logic by means of binary coded decimal (BCD) switches.

The first grinding feed rate is read in BCD form along a line 74 into an input of a digital rate generator (DRG), a second input of the DRG being connected to the output of a crystal controlled master oscillator which provides a high stability reference input frequency to the DRG. The output signal from the DRG is passed to an input C of the WDC in the form of a pulse train whose frequency is controlled by the BCD input data. These pulses cause a count pulse signal to be transmitted from the (WDC) to a control counter and a synchronised output in the form of a step pulse is also transmitted from an output G of the (WDC) to an acceleration and drive unit (ADU) for the wheelhead stepping motor M.

The step pulse output is also fed to gate circuits A1 and A3 both of which are associated with a second ADU for the workrest stepping motors (12, 14).

The BCD date on the first end point i.e., the number of programmed counts in the first grinding feed is read into a digital magnitude comparator (DMC) along a line 76 from the enable logic, the latter number of counts being compared with the contents of the control counter. In addition, the control counter is employed in conjunction with a digital display to provide a visual indication of the wheelhead position during the feed sequence.

When the DMC detects equality between the counts recorded on the counter and the programmed end point indicating that the diameter of the workpiece has been reduced from $D_1$ to $D_2$ a signal is generated from the output of the DMC to an input D of the WDC logic, which terminates the first feed and initiates the first dwell period (sparkout).

The termination of the first dwell period produces a signal along line 78 to advance the workrest. This signal enables logic gate A2 to pass a "fixed advance rate" pulse train to the ADU associated with the workrest stepping motors.

The workrest jaws 20, 22 will advance at this fixed rate until they contact the workpiece (FIG. 7) at which point a signal from a pressure sensitive transducer, mounted on the workrest jaw, will set a "memory of workrest on work" circuit. This in turn, will disable gate A2 and stop the workrest stepping motors. This initial contact pressure between the workpiece and the workrest jaws is extremely low, and therefore, no deflection of the workpiece is caused thereby.

Once the workrest jaws have been advanced to contact the workpiece as described, the second grinding feed will commence at a rate determined in the same manner as the first feed.

Since logic gate A1 is not enabled, step pulses at the second grinding feed rate, are fed to both the wheelhead ADU and the workrest ADU causing both to step at the same rate.

Both motors will continue to be synchronized (FIG. 8) until an in-process gauge generates a size signal, indicating that the diameter of the workpiece has been reduced to $D_3$, to input B of the (WDC). Each radial increment of advance of the grinding wheel causes a conjoint radial increment of advance of the workrest jaw buttons whereby the desired axial location of the workpiece will be continuously maintained. The size signal to the WDC logic will initiate resetting of wheelhead to a programmed total feed value at a fixed reset rate.

Gate A3 is enabled to permit step pulses at the fixed reset rate to retract the workrest and the memory of workrest on work circuit will be reset at the start of the next grind cycle.

Resetting of wheelhead and workrest continues until the DMC detects equality between the total counts recorded in the control counter and the programmed total feed at which point the reset rate is stopped.

The wheelhead and workrest are then in the reset position ready for the next grinding cycle.

The paths of the workrest shoes are such that the forces applied by the grinding wheel on the workpiece are always opposed by equal and opposite forces applied by the shoes thereby maintaining the workpiece on a true axis throughout the stock removal of the grinding process.

The pulse feed advance during the third stage ceases in accordance with the control program which may or may not incorporate an in-process sizing gauge for signaling when a predetermined size of the workpiece has been reached. The position of the workrest shoe relative to the true axis of the workpiece may be used to cause the cessation of the pulse feed advance. Any such "size signal" can then be used to reset, i.e., retract the wheel and the workrest shoe or shoes from the workpiece to allow unload and loading of the workpiece.

The size signal initiates a sequence in which the grinding wheel is first removed from the workpiece, followed by removal of the workrest shoe or shoes from the workpiece. This avoids any marking of the workpiece which sometimes occurs if both workrest and wheel are simultaneously retracted. The signal to retract the wheel and workrest shoe or shoes may also be used to reset the wheel and shoe or shoes by a programmed amount so as to be ready to recommence the grinding of a further new workpiece.

As a result of the manner in which the grinding cycle described above is performed, in particular, by having the workpiece at a resultant but not predetermined diameter $D_2$ before the workrest shoes come into contact with the workpiece, and by having the finished workpiece size accurately controlled by the automatic, in process, size control gauge, it is possible to automatically account for all the normal variables associated with cylindrical grinding, for example wheel wear, thermal effects on machine elements, condition of cutting tool and pad wear.

It is to be understood that only one of the workrest shoes needs to be operated by a stepping motor, the other shoe or shoes being operated by, for example, a rotary hydraulic cylinder. If only one shoe is operated by a stepping motor it is the shoe which exerts a force on the workpiece in a direction substantially opposite to the direction of feed movement of the grinding wheel.

If desired, conjoint advancement of the workrest jaws and the grinding wheel may take place throughout the entire grinding cycle.

In order to minimize cycle time, the workrest jaws can be manually advanced by rotating the control knobs 56 until the workrest buttons 38 contact the workpiece prior to a grinding operation. This will assure that resetting of the workrest will take place in an absolute minimum of time and will require a minimum expenditure of energy.

What is claimed is:

1. A cylindrical grinding machine comprising means for supporting a workpiece for rotative displacement about the axis thereof, a grinding wheel assembly including at least one grinding wheel and means for rotatively displacing said grinding wheel about the axis thereof, means for advancing said grinding wheel to a selected first position whereat further advancement of said rotating grinding wheel will effect stock removal from a rotating workpiece, a workrest jaw, means for advancing said workrest jaw along a perdetermined path from a retracted position to a forward position where said workrest jaw non-deflectively contacts the rotating workpiece, means for advancing said grinding wheel from said first position and conjointly advancing said workrest jaw along said perdetermined path, from said forward position at predetermined rates of advance to advanced positions substantially equidistant from the non-deflected axis of the rotating workpiece, said means for advancing said workrest jaw from said retracted position to said forward position including a pressure sensitive transducer mounted on said workrest jaw, and means for energizing said workrest jaw advancing means until said pressure sensitive transducer contacts the rotating workpiece.

2. A cylindrical grinding machine comprising means for supporting a workpiece for rotative displacement about the axis thereof, a grinding wheel assembly including at least one grinding wheel and means for rotatively displacing said grinding wheel about the axis thereof, a workrest jaw, a spindle including a workrest jaw engaging portion at the end thereof, operatively associated with said workrest jaw, means for rotatively advancing said spindle to advance said workrest jaw, and means for non-rotatively advancing said spindle to advance said workrest jaw including means for preventing the operation of said rotatively advancing means.

3. A cylindrical grinding machine comprising means for supporting a workpiece for rotative displacement about the axis thereof, a grinding wheel assembly including at least one grinding wheel and means for rotatively displacing said grinding wheel about the axis thereof, workrest jaw means, a spindle including a workrest jaw engaging portion operatively associated with said workrest jaw means, said spindle including a threaded portion and an axially extending splined portion, an internally splined sleeve member matingly engaging with said splined portion, an internally threaded nut for matingly engaging with said threaded portion, housing means for rotatably supporting said sleeve member and said nut, selectively energizable motor means including a rotatable spindle keyed to said nut whereby rotation of said nut will be prevented except when said motor means is energized, said sleeve member including a worm wheel on the periphery thereof, a worm rotatably supported by said housing in operative engagement with said worm wheel whereby rotation of said worm in a selected direction will rotatively advance said spindle, and means for preventing the rotation of said sleeve member so that energization of said motor means in a selected direction will non-rotatively advance said spindle.

4. A cylindrical grinding machine according to claim 3, wherein said motor means comprises a stepping motor.

5. A cylindrical grinding machine according to claim 4, wherein said worm includes a manually rotatable knob portion at one end thereof.

6. A cylindrical grinding machine according to claim 5, wherein said preventing means comprises clamp means operatively associated with the periphery of said sleeve member, said clamp means including a selectively rotatable bolt.

* * * * *